United States Patent [19]

Rehberg

[11] Patent Number: 4,851,814

[45] Date of Patent: Jul. 25, 1989

[54] DOOR ALARM

[76] Inventor: Harry K. Rehberg, 35 Mattinee Bay, Winnipeg, Canada, R2G 1X9

[21] Appl. No.: 171,475

[22] Filed: Mar. 21, 1988

[30] Foreign Application Priority Data

Feb. 18, 1988 [CA] Canada ..... 559251

[51] Int. Cl.[4] ..... G08B 13/08

[52] U.S. Cl. ..... 340/546; 340/547

[58] Field of Search ..... 340/545-547; 200/61.62; 70/14, 16, 19, 58

[56] References Cited

U.S. PATENT DOCUMENTS

| | | | |
|---|---|---|---|
| 1,305,190 | 5/1919 | Bobo | 340/546 |
| 3,926,018 | 12/1975 | Joersz | 70/19 |
| 4,057,773 | 11/1977 | Cohen | 340/547 X |
| 4,271,338 | 6/1981 | Rakocy | 340/547 X |
| 4,339,747 | 7/1982 | Maybee | 340/547 |
| 4,427,975 | 1/1984 | Kinzie | 340/547 |
| 4,575,713 | 3/1986 | Piper | 340/546 |

*Primary Examiner*—Glen R. Swann, III
*Assistant Examiner*—Thomas J. Mullen, Jr.
*Attorney, Agent, or Firm*—Stanley G. Ade; Adrian D. Battison; Murray E. Thrift

[57] ABSTRACT

A portable door alarm is used in such environments as hotel rooms and the like. The alarm has a housing containing the alarm mechanism with a front face on which the alarm controls are mounted. The housing is suspended from the shank of a door handle by a locking clamp connected to the housing by a hinge. The hinge allows the housing to be pivoted upwardly so that the alarm controls can be manipulated from a standing position. The activation of the alarm is with a two component switch. The components of the switch are mounted on the door frame and the door in adjacent positions. The door mounted switch component is connected to the alarm mechanism in the housing with a relatively long flexible electrical wire. The arrangement is such that when a door is opened, the switch circuit opens and the alarm is activated.

16 Claims, 3 Drawing Sheets

DOOR ALARM

FIELD OF THE INVENTION

The present invention relates to door alarms and more particularly to portable door alarms for indicating an unauthorized opening of a door.

BACKGROUND

Concern over personal security has led to the development of various alarm devices for indicating the unauthorized entry into a residence. With a permanently occupied home, it is conventional to install a permanent alarm system connected to all doors and windows. This may be used alone or in conjunction with an interior alarm system such an a motion sensor. These permanent systems are not suitable for use in temporary premises such as hotel rooms and many apartments. The primary concern with such premises is an unauthorized entry through the door, since windows are often inaccessible or permanently closed. Potential solutions to the problem are described in U.S. Pat. Nos. 1,305,190, 4,339,747, 4,575,713.

In U.S. Pat. No. 1,305,190, there is described an alarm that may be suspended from a doorknob and which has a spring loaded switch that may be held in an electrically open condition by inserting a pair of spring blades between the door and door frame. When the door is opened, the blades separate and the switch contact is closed, thus activating the alarm. With this device, both the switch and the alarm mechanism are accessible to an intruder so that the alarm may very quickly be silenced before an adequate alert has been given.

U.S. Pat. No. 4,339,747 describes an alarm that is mounted on a doorknob and incorporates a pendulum switch that activates an alarm when the knob is turned. The major drawback of this device is its complete enclosure of the doorknob when installed. This means that the doorknob cannot be used in the normal way without fully removing the alarm. Additionally, because the alarm must be removed to grasp the door knob, its removal is made very simple so that an intruder could simply remove the alarm from the doorknob, giving the opportunity to silence it.

U.S. Pat. No. 4,575,713 describes another pendulum type alarm. In this case, the alarm is suspended from a doorknob using a flexible strap. Again, the alarm could readily be removed from the doorknob and silenced by an intruder.

The aim of the present invention is to provide an improved portable alarm suitable for use in hotel rooms and the like.

SUMMARY

According to the present invention there is provided a door alarm comprising:

an alarm means for generating an alarm signal, including a housing and manually actuable alarm conditioning means on a front face of the housing;

switch means for activating the alarm including a first component with a switch head adapted to be removably mounted on a door adjacent an edge thereof and a flexible electrical wire connecting the switch head to the alarm means, and a second component adapted to be mounted on a door frame adjacent the switch head of the first component, the components and alarm means being so constructed and arranged that moving the switch head away from the second component will activate the alarm;

clamp means for clamping the alarm means to a doorknob shank, the clamp means including locking means for locking the clamp onto the door knob shank; and hinge means secured to the housing and to the clamp means for suspending the housing from the clamp means, with the housing pivotable upwardly about a hinge axis substantially parallel to the front face of the housing.

Because the alarm locks to the doorknob shank the knob itself is available for conventional use at all times. The hinge linking the clamp and the housing is of particular importance, as without this arrangement, the alarm conditioning switches on the front face of the housing would only be accessible if the operator bent over, crouched or kneeled on the floor. This is clearly unacceptable.

The two components of the switch are preferably mounted on the door and door jamb through the use of releasable double faced tape. One side of the tape is used to adhere to the switch component and the other side will be provided with a peelable release sheet. By peeling off the release sheet, the exposed adhesive can be used to secure the switch component to the door or door jamb as the case may be.

The preferred alarm is a multifunction device that may serve as a door chime, a delayed alarm or an instantaneous alarm. The delayed alarm is used to allow authorized entry and resetting of the alarm before the alarm signal is actuated, while the door chime allows unimpeded access and simply produces a signal that the door has been used.

It is also preferred that the housing be equipped with an intruder light. This light may be operated like the door chime to indicate that the door has been opened, but remains illuminated until the alarm is reset.

BRIEF DESCRIPTION OF THE DRAWINGS

In the accompanying drawings, which illustrate an exemplary embodiment of the present invention.

DETAILED DESCRIPTION

Figure 1:
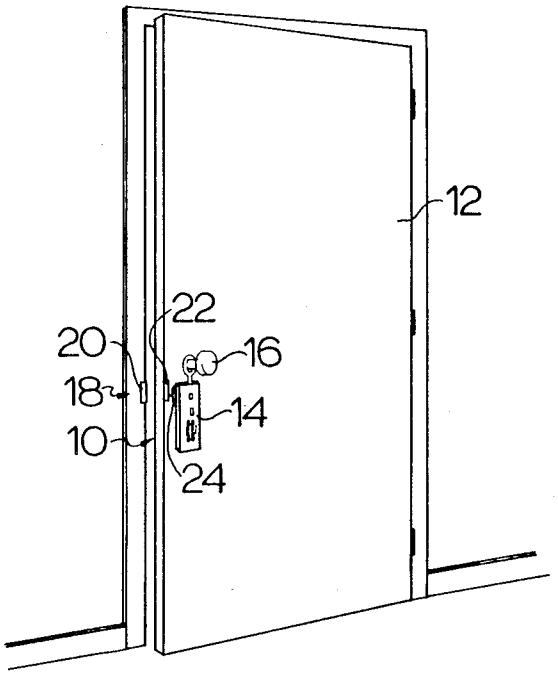
FIG. 1 is an isometric view of a door equipped with an alarm according to the present invention.

Referring to the accompanying drawings, particularly to FIG. 1, there is illustrated an alarm 10 mounted on a door 12. The alarm has a housing 14 that is suspended from the doorknob 16 on the inside of the door and a switch 18 for activating the alarm. The switch has a passive component 20 that is mounted on the door frame and an active component 22 that is mounted on the door, adjacent its edge. The arrangement is such that when the door is closed, the two components 20 and 22 lie beside each other. The active component 24 of the switch is connected to the housing 14 by an electrical wire 24.

Figure 2:
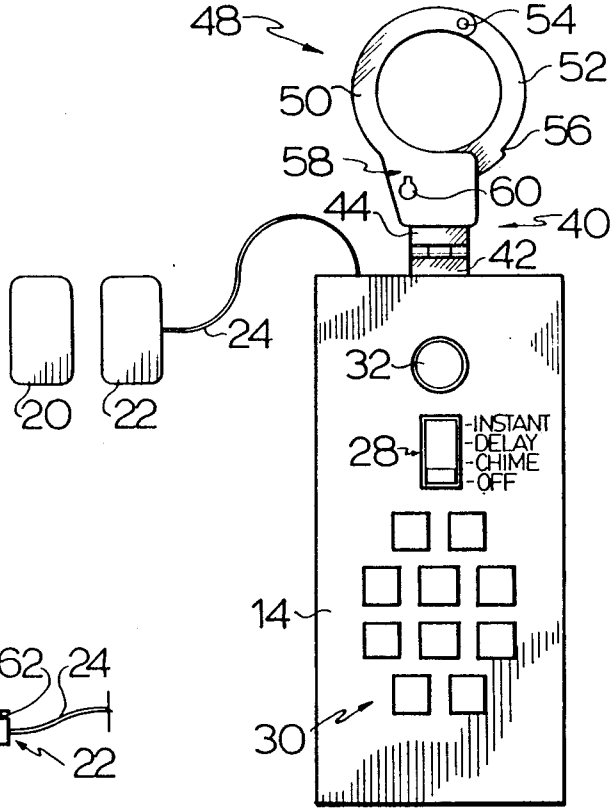
FIG. 2 is a front elevation of the alarm.
Figure 3:
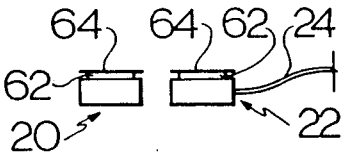
FIG. 3 is a plan view of the switch components.
Figure 5:
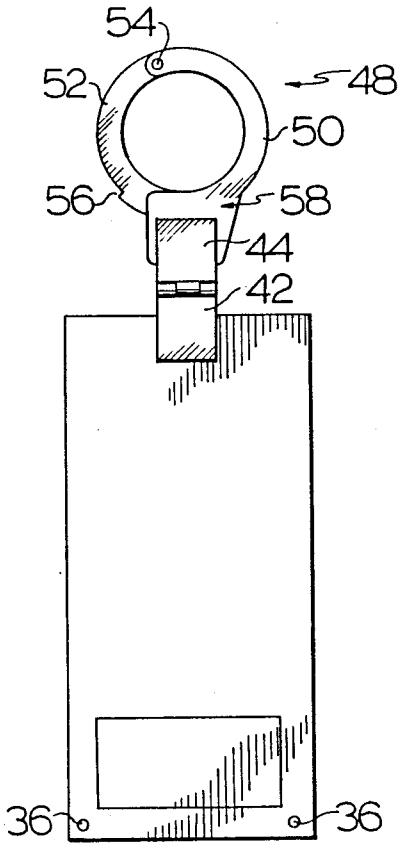
FIG. 5 is a back elevation of the alarm.

The physical construction of the alarm is most particularly illustrated in FIGS. 2, 3 and 5. The housing 14 is an elongate rectangular, metal enclosure. On its front face 26 it carries a multiposition selector switch 28. The available switch positions are off, chime, delay, and instant. Below the selector switch 28 is a key pad 30 with a number of coded keys. Above the selector switch is an intruder light 32. On either side of the housing are louvered grills 34. These allow the emission of an audible alarm sound from within the housing. The use of plural grills on opposite sides of the housing makes it difficult for an unauthorized person to cover the grills, thus muting the alarm sound.

On the back surface of the housing are rubber bumpers 36 that protect the door surface from impacts with the housing. Also shown on the back surface in FIG. 5 is a battery compartment cover that may be removed to allow the exchange of alarm batteries.

Figure 4:
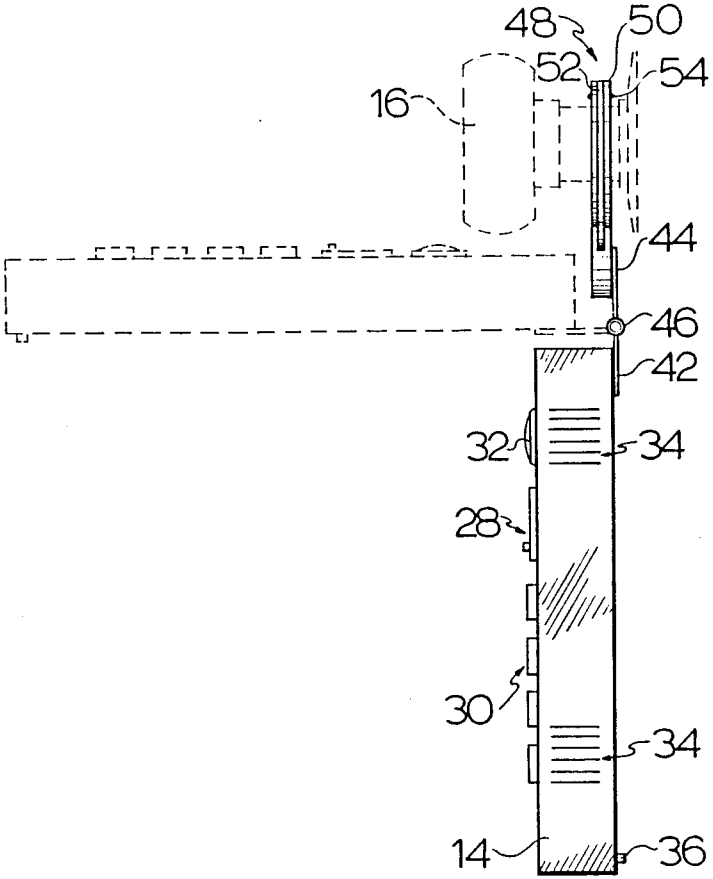
FIG. 4 is a side elevation of the alarm.

A hinge 40 is connected to the housing i4 at its top end. The hinge has a bottom plate 42 and a top plate 44 joined by a hinge pin 46 (FIG. 4). The bottom plate 42 is permanently secured to the back face of the housing 14 and projects above the top of the housing so that the hinge pin 46 is generally parallel to the top and front faces of the housing. The top plate 44 is permanently secured to a door knob clamp 48. The hinge is constructed to allow the plate 42 to pivot in both directions from the plane of plate 44. This allows the housing 14 to swing upwardly as shown in ghost line in FIG. 4, and allows the clamp to lie flat on the back of the housing 14 for storage or transport.

The clamp has a fixed arcuate arm 50 permanently secured to the hinge plate and an arcuate pivoting arm 52 that has one end pivotally connected to the free end of the fixed arm 50 by a pivot pin 54. The pivoting arm has ratchet teeth 56 formed in its outer face to engage with a locking pawl (not shown) of a clamp lock 58 at the base of the fixed arm 50. where it joins the hinge plate 54. The lock 58 is key operated and has a key hole 60 in its front face to accommodate the key. The clamp thus has the general configuration of one part of a pair of handcuffs. The use of plural ratchet teeth 56 ensures that the pivoting arm 52 can be locked to the fixed arm 50 in several positions, with a varying size of opening 53 between them. This arrangement is used to lock the alarm to the shank of the doorknob, as illustrated in ghost lines in FIG. 4. Normally, the alarm will be suspended from the clamp, leaving the doorknob free to be used in the normal way. Where the alarm is to be reset, the housing 14 may be pivoted upwardly around the horizontal axis of the hinge pin 46 so that the key pad and selector switch are readily available, as illustrated in ghost line in FIG. 4.

As illustrated in FIG. 3, the two switch components 20 and 22 are equipped with double faced adhesive tape 62 on their inner faces, that is the faces that are to be secured to the door frame and door. The outer layer of adhesive on the tape is covered with an appropriate release sheet 64 that is peeled off before the switch component is secured to the door or door frame. The passive compoent 20 is a permanent magnet, and the active component 22 is a normally open switch that closes when in proximity to a magnetic field. Switch components of this sort are known and are available as "off the shelf" items. The normally open switch, and an alarm that is activated by an open switch circuit ensure activation of the alarm if the switch wire is cut.

Figure 6:
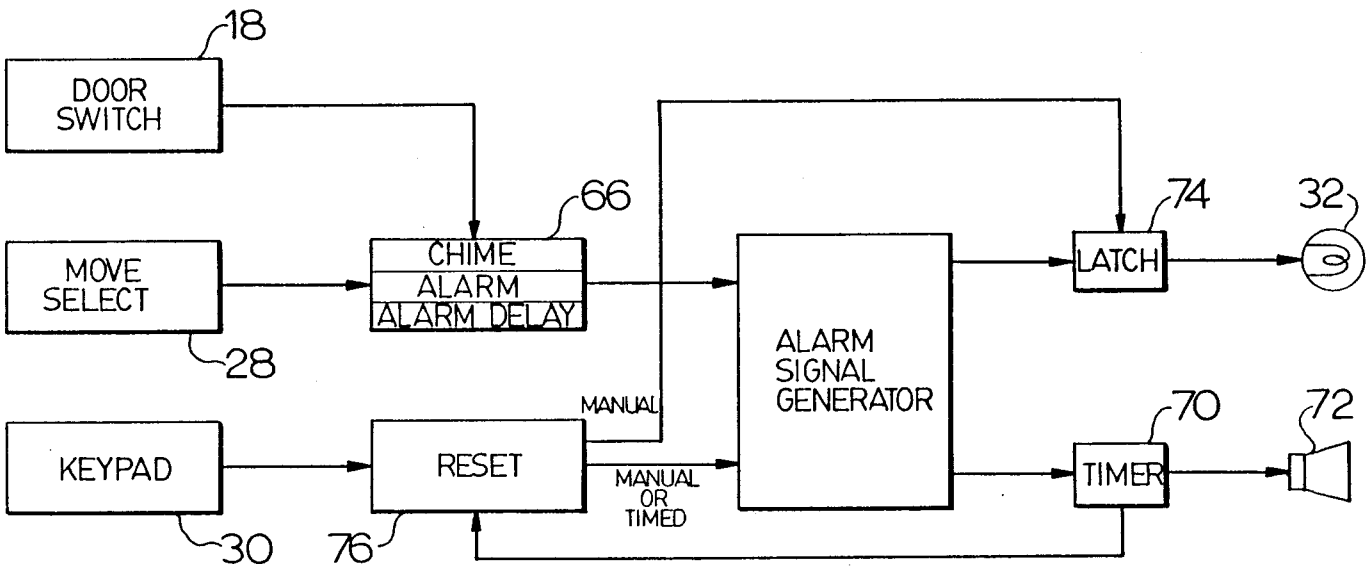
FIG. 6 is a schematic block diagram of the alarm operating system.

FIG. 6 illustrates a schematic diagram of the operating system of the alarm. According to the selected position of the multiposition switch 28, the selector circuit 66 acts on a signal from the door switch indicating the door has been opened to produce, through the alarm signal generator circuit, a brief signal as a door chime, an immediate, continuous alarm signal or a continuous alarm signal after a predetermined time delay, say 20 seconds. The signal generator supplies alarm signals through a timer 70 to a speaker 72 to generate the desired audible alarm. In addition, the receipt of any signal from the circuit 66 by the signal generator circuit will produce a signal to the intruder light 32 through a latching circuit 74. The latching circuit responds to the presence of any signal from the signal generator to close a circuit powering the intruder light continuously, until the alarm is manually reset.

The key pad provides signals to the alarm signal generator through a reset circuit 76. This allows an authorized user of the alarm to enter a predetermined code through the key pad that will reset the alarm to an initial state when desired. The timer 70 in the circuit to the alarm speaker 72 acts to shut off the audible alarm after a predetermined time, say 5 minutes, and to reset the alarm for a further operation at the same time. This conserves battery life. The intruder light 32 is not extinguished when the reset circuit 76 is activated by the timer 70.

The alarm described in the foregoing is portable, easily used and is acceptable for use in such environments as hotel rooms, where it is not acceptable to mount an alarm through the use of such devices as wood screws. At the same time, the alarm is very secure as it is locked with a very rugged clamping mechanism on the shank of the doorknob. The use of a hinge between the clamp and the housing enables the alarm to be controlled without the operator having to adopt an uncomfortable or inconvenient posture.

While one embodiment of the present invention has been described in the foregoing, it is to be understood that others are possible within the scope of the invention. It is to be understood that the scope of the invention is to be ascertained solely by references to the appended claims.

I claim:

1. A door alarm comprising:

an alarm means for generating an alarm signal, including a housing and manually actuable alarm conditioning means on a front face of the housing;

switch means for activating the alarm including a first component with a switch head adapted to be removably mounted on a door adjacent an edge thereof and a flexible electrical wire connecting the switch head to the alarm means, and a second component adapted to be mounted on a door frame adjacent the switch head of the first component, the components and alarm means being so constructed and arranged that moving the switch head away from the second component will activate the alarm;

clamp means for clamping the alarm means to a doorknob shank, the clamp means including locking means for locking the clamp onto the door knob shank; and hinge means secured to the housing and to the clamp means for suspending the housing from the clamp means, with the housing pivotable upwardly about a hinge axis substantially parallel to the front face of the housing.

2. An alarm according to claim 1 wherein the switch means include releasable pressure sensitive adhesive for mounting the switch head of the first component and the second component on the door and door frame respectively.

3. An alarm according to claim 2 wherein the pressure sensitive adhesive comprises an adhesive tape and including a release sheet over an adhesive layer of the adhesive tape.

4. An alarm according to claim 1 wherein the switch head of the first component is a normally open switch, when in proximity to a magnetic field, and the second component is a permanent magnet.

5. An alarm according to claim 1 wherein the clamp comprises two pivotally connected arms.

6. An alarm according to claim 5 wherein each arm is substantially arcuate and the arms define an opening therebetween in a closed condition of the clamp means.

7. An alarm according to claim 6 wherein the clamp means includes locking means for securing the arms to one another in the closed condition.

8. An alarm according to claim 7 wherein the locking means selectively secure the arms together in a plurality of positions.

9. Alarm means according to claim 8 wherein the locking means are key operated.

10. An alarm according to claim 1 wherein the alarm conditioning means include a key pad for the manual entry of an alarm code.

11. An alarm according to claim 1 wherein the alarm means include means for limiting the duration of an alarm signal.

12. An alarm according to claim 11 wherein the alarm means include an intruder light mounted on the housing, and means for illuminating the light in response to activation of the alarm and maintaining the light in the illuminated state.

13. An alarm according to claim 11 including reset means for automatically resetting the alarm means for operation after expiry of an audible alarm signal.

14. An alarm according to claim 1 wherein the housing contains plural sound emitting grilles at spaced positions thereon.

15. An alarm according to claim 14 wherein the sound emitting grilles are located on opposite lateral sides of the housing.

16. An alarm according to claim 1 wherein the hinge means are constructed and arranged to allow the clamp means to pivot to a position lying along a back face of the housing.

* * * * *